US005726135A

United States Patent [19]

Khorramian

[11] Patent Number: 5,726,135

[45] Date of Patent: Mar. 10, 1998

[54] PHOSPHORUS-FREE AND ASHLESS OIL FOR AIRCRAFT AND TURBO ENGINE APPLICATION

[76] Inventor: Behrooz A. Khorramian, 130 Woodridge Pl., Leonia, N.J. 07605-1625

[21] Appl. No.: 763,658

[22] Filed: Dec. 11, 1996

[51] Int. Cl.[6] ..... C10M 135/18

[52] U.S. Cl. ..... 508/444; 508/485

[58] Field of Search ..... 508/363, 387, 508/444, 485

[56] References Cited

U.S. PATENT DOCUMENTS 4,368,133 1/1983 Forsberg ..... 508/240

4,612,129 9/1986 Di Biase et al. ..... 508/363

*Primary Examiner*—Jacqueline V. Howard

[57] ABSTRACT

Phosphorus-free and ashless high-temperature aircraft and turbo engine lubricant that contains no halogens or hazardous substances is disclosed. The phosphorus-free lubricating oil may be prepared from pentaerythritol tetraester, methylolpropane triester, or their combinations, ashless dithiocarbamate additives, a dialkydiphenylamine, an alkylphenylnaphthylamine, a triazole derivative, a rest inhibitor or metal deactivator, and an anti-foam. The use of this lubricating oil in addition to its superior wear and friction performance over the standard lubricating oil provides a safe and an environmentally benign gas turbine engine oil for aircraft and turbo engines.

15 Claims, No Drawings

PHOSPHORUS-FREE AND ASHLESS OIL FOR AIRCRAFT AND TURBO ENGINE APPLICATION

The present invention relates to improved gas turbine engine oil. This lubricating oil is an improvement over a standard lubricant formulation that is predominantly an ester base oil. The improved oil contains ashless dithiocarbamate additives in addition to other specified additives. This new lubricant does not contain any phosphorus-containing additives and yet shows superior quality and performance with remarkable environmental safety characteristics. Lack of phosphorus in the formulation eliminates the release of a potent neurotoxin chemical generated at high temperature by phosphorus-containing lubricants presently used in gas turbine engines.

BACKGROUND OF THE INVENTION

The current invention includes a phosphorus-free lubricating oil for gas turbine and turbo engines. In general, lubricants perform a variety of functions in gas turbine applications. One of the most important functions is to reduce wear and friction in moving machinery. Also, lubricants protect metal surfaces against oxidation and corrosion.

The performance of gas lubricant oils is a function of the additive composition they contain. The most common types of additives are: ashless antiwear agents, antioxidants, antifoams, corrosion inhibitors, and rest inhibitors.

Requirements placed on gas turbine engine oils, namely wear reduction, oxidation and aging stability, cannot be met by hydrocarbon oils. Thus, synthetic base oils became the logical choice for a aviation lubricants. The first generation of oils (Type 1) were diesters but, over the last 25 years, these have slowly lost ground to the more thermally stable (Type 2) polyol esters. Type 2 aviation gas turbine lubricants are produced to a viscosity of 5 centiStokes at 100° C. The current military specification, MIL-L-7808, requires two grades of oils, Grade 3 and Grade 4, with viscosities of 3 and 4 centiStokes at 100° C., respectively. Grade 3 is intended for normal use and Grade 4 for applications which require higher viscosity and greater thermal stability.

Another issue which has become extremely important in recent years is the environmental concern over the use of chemicals in lubricants which result in environmental damage, ozone depleting chemicals (ODC) being one example. Halogenated materials, especially chlorinated compounds, are suspected to be involved in ozone depletion in the upper atmosphere. In addition, these compounds under high temperature conditions generate acids which are extremely toxic and corrosive. The concern over environmental issues mandates that the lubricant and its additives used in aircraft engine be environmentally benign and: (1) reduce the risk of environmental damage, (2) reduce the amount of pollutants in the surroundings, and (3) minimize hazardous waste during the life cycle (production, use, and disposal). For example, one of the polyol esters suitable for aviation base oils is trimethylolpropane triester, that under high temperature conditions reacts with the tricresylphosphate (TCP) antiwear agent, resulting in a highly toxic material. Tricrecylphosphate is toxic because of its orthocresol impurities. MIL-L-7808 requires the use of TCP with no more than 1 percent by weight orthocresol isomer. Triarylphosphate (TAP) is another antiwear which is carcinogenic due to its arsenic content. According to MIL-L-7808, the manufacturer of the lubricant should certify that no carcinogenic or potentially carcinogenic constituents are present in any lubricating oil finished as defined in the *Hazard Communication Standard* 29 CFR 1910.1200. It also requires that the engine oil shall have no adverse effects on the health of the personnel dealing with it.

All gas turbine engines have three basic components, an air compressor to supply air to the combustion chambers, the combustion chambers themselves, and a turbine which drives the compressor and is itself driven by the combustion gases. Due to the high ratio between the power output of turbine and oil volume, the operating temperature of the turbine engine can be as high as 160° C. The critical requirement for all gas turbine lubricants is their ability to cope with a wide range of temperatures. The hottest lubricated components are the turbine bearings. The oil in the turbine bearing may be subject to a temperature as high as 280° C. The residence time of the oil during normal operations is short, but after engine shut-down the bearing temperature will often rise even higher because of heat soak from the blades after the cooling air-flows have ceased. A small quantity of retained oil will therefore be exposed to a very high temperature until the bearings cool. It is thus necessary to choose high-temperature components for aircraft turbine oil.

Another safety aspect of the lubricant in aviation application is the reliability of lubricant performance. All the components and systems in aircraft which are critical for safe operation involve lubrication. A survey of over 900 aircraft accidents in the United Kingdom between 1984 and 1988 showed that nine were directly related to beating failures. One of these was caused initially by galling and one by excessive wear, both caused because of lubrication failure.

Among factors which contribute to the effectiveness of a lubricant oil for gas turbine engine lubricant is high temperature antiwear property which reduces metal-to-metal contact in moving machinery. With an effective antiwear additive, metal scoring, welding, and metal wear can be prevented.

Certain lubricating oil compositions are known in the prior art. For instance, U.S. Pat. No. 4,612,129, incorporated herein in its entirety by reference, discloses lubricating oil compositions containing at least one metal salt of at least one dithiocarbamic acid of the formula $R_1(R_2)N\text{-}CSSH$. Metal containing additives contribute to deposition in the engine and thus cannot be used for gas turbine engine applications as explained (see above).

U.S. Pat. No. 4,917,809, incorporated herein in its entirety by reference, discloses a lubricating composition containing benzotriazoles and olefin copolymers.

U.S. Pat. No. 3,850,824; 3,901,815; 4,096,078; 4,119,551; 4,124,513; 4,124,514; 4,125,479; 4,141,844; 4,157,970; 4,157,971; 4,179,386; 4,188,298; 4,226,732; 4,248,721; and 4,320,015 incorporated herein in their entirety by reference, disclose lubricant compositions containing base fluids made of the reaction of pentaerythritol or trimethylolpropane and an organic monocarboxylic of 2–18 carbon atoms and containing an alkylphenyl or alkarylphenyl naphthylamine, a dialkyldiphenylamine, a hydrocarbyl phosphate ester made of tricresyl phosphate or triaryl phosphate, and metal deactivators.

A problem with prior art lubricant compositions is their inclusion of phosphate esters which either are environmentally unsafe or at high temperature react with polyol ester base fluids, resulting in environmentally unsafe chemicals. For example, trimethylolpropane triester reacts with tricresylphosphate to form trimethylolpropanephosphate which is a neurotoxin chemical as shown in the following reaction:

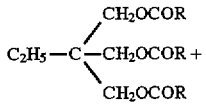

Trimethylolpropane Triester

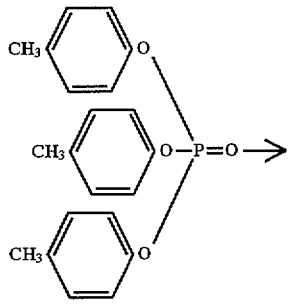

Tricresylphosphate

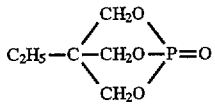

Trimethylolpropanephosphate

Formation of Trimethylolpropanephosphate

In view of the increasing strictness of environmental regulations, as well as the increased awareness of environmental issues, there has developed a need to produce gas turbine engine oil that is in compliance with hitman and environmental safety standards, while at the same time, facilitates optimum engine performance and protection.

The present invention meets this need by providing improved lubricating oil for gas turbine engines, having competitive manufacturing cost efficiency and also meeting the requirements of MIL-L-7808K established for implementation in Jul. 20, 1994. The base fluid and additives of the present invention contain ingredients that have never before been used in such combinations for gas turbine engine lubricants.

SUMMARY OF THE INVENTION

It is an object of the invention to provide a phosphorus-free lubricating oil for gas turbine engine that does not contain any phosphorus or hazardous substances.

A further object of the invention is to provide a phosphorus-free lubricating oil for gas turbine engine that does not contain any phosphate esters or any other hazardous substances.

A still further object of the invention is to provide a phosphorus-free lubricating oil for gas turbine that is ashless and does not contain any metals or hazardous substances.

Additional objects and advantages of the invention will be set forth in part in the discussion that follows, and in part will be obvious from the description, or may be learned by the practice of the invention. The objects and advantages of the invention will be attained by means of the instrumentalities and combinations particularly pointed out in the appended claims.

To achieve the objects and in accordance with the purpose of the invention, as embodied and broadly described herein, the present invention provides for improved lubricating oil formulations for aircraft and turbo engines that are based on a standard lubricant formulation such as predominantly polyol esters. The following ingredients are then added to the base lubricating fluid: a metal deactivator to deactivate the catalytic effect of copper and bronze in oxidizing the base oil; a rust inhibitor/metal deactivator to deactivate the catalytic effect of iron, steel (such as M-50), aluminum, silver, magnesium, titanium, molybdenum, and chromium; silicone anti-foam agent; an antioxidant system made of alkylphenyl or alkarylphenyl naphthylamine and a dialkyldiphenylamine; and a methylene bis (dibutyldithiocarbamate) antioxidant/extreme pressure additive or an ashless ester of a dithiocarbamate derivative which functions as an antiwear/antioxidant or their combination.

The lubricating oil of the present invention is prepared by adding ingredients to a base oil. The nature of the base oil is as disclosed above. The base oil is poured into a container where it is stirred and heated. The other chemical ingredients are then added to the base oil. Preferably, the solid antioxidants and other solid additives are added first and are completely mixed before the remaining chemicals are added. After all the chemicals are added, the complete mixture is continually heated and constantly stirred for a sufficient amount of time to insure complete mixing.

All the formulations were tested and their performance properties were determined to be in accordance with MIL-L-7808 and MIL-L-23699 for gas turbine engines.

DETAILED DESCRIPTION OF THE INVENTION

Reference will now be made in detail to the presently preferred embodiments of the invention, which, together with the following examples, serve to explain the principles of the invention.

The present invention first provides a formulation that is a phosphorus-free and ashless. This phosphorus-free ashless formulation can be prepared either as a lubricating oil or as a concentrated additive for lubricating oils. The base oil can be a natural or synthetic lubricating oil. Natural oils include animal oils and vegetable oils such as castor oil, sunflower oil, grape seed oil, and lard oil. The synthetic base oil is selected from pentaerythritol fatty and tetraesters, trimethylolpropane fatty and triesters, and mixture thereof; and that the base oil optionally further includes one or more polyol esters sleeted from adipate diesters, azelate diesters, sebacate diesters, and neopentyl diseters as well as optionally one or more of the listed natural oils. Among these base fluids are pentaerythritol tetraesters with the general formula of $C(CH_2OCOR)_4$, where R is an akyl group with 4 to 10 carbon atoms; trimethylolpropane esters with the general formula of $CH_3C_2(CH_2OCOR)_3$, where R is an alkyl group with 4 to 10 carbon atoms; neopenthylglycol esters with the general formula of $(CH_3)_2C(CH_2OCOR)_2$, where R is an alkyl group with 4 to 10 carbon atoms; esters of adipic acids with the general formula of $C_4H_8(COOR)_2$, where R ranges from diisooctyl to ditridecyl; azelate diesters with the general formula of $C_7H_{14}(COOR)_2$, where R ranges from diisooctyl to diisodecyl; sebacate diesters with general formula of $C_8H_{16}(COOR)_2$, where R is di-2-ethylhexyl or dioctyl; and phthalate diesters with the general formula of $(C_6H_4)(COOR)_2$, where R ranges from diisooctyl to ditridecyl. Other potential base fluids are organo-metalloids, aromatic hydrocarbons or ethers, fluorinated hydrocarbons or ethers, silicone fluids, polyphenyl ethers, and perfluoroethers.

The base oil accounts for approximately 90 percent by weight of the total concentration of phosphorus-free and ashless lubricating oil formulation. The additional ingredients are then added to the base oil.

The first additives to the base lubricating oil are ashless antiwear. The wear is the loss of surface material that occurs when a lubricant film fails to separate solids that are moving against each other. The wear rate for each part is not only related to the type of antiwear additive used but also related to the design and metallurgy of the parts. Them are two types of wear that occur in moving parts, abrasive and adhesive wear. The wear inhibition occurs by several processes: chemical lapping, formation of adsorbed surface films, and formation of metal (usually iron) compounds between antiwear additives and the metal surface. Among these compounds are iron phosphate, iron sulfide, and iron halide (e.g., chloride). These compounds provide boundary lubrication. Most metal surfaces at low temperatures are completely covered with adsorbed films of additives which may be one or more molecules thick. These adsorbed films lower the surface energy. The more stable the adsorbed film, the greater the reduction in surface energy. The actual protection against wear is believed to be due to the ability of the adsorbed film to withstand the local contact pressures, while being able to shear readily with low frictional resistance when rubbed by the opposing surface. Suitable antiwear agents are polar molecules with strong adhesion to the metal surface and a long nonpolar chain that will orient itself perpendicularly to the surface and thus create a thick film. Among antiwear additives are long-chain fatty acids such as palmitic and stearic acids and their esters, vegetable oils and fats, phosphate esters, sulfurized olefins, sulfurized sperm oil, metal dithiophosphates, metal dithiocarbamate, borates, and phosphate compounds.

In this invention, we only consider ashless phosphorus-free antiwear agents for the reasons indicated earlier. Moreover, we shall not consider halogen-containing additives because of their adverse reactivity with metal surfaces, the toxicity of halide acids (e.g., HF, HCl, HBr) and ozone-depleting characteristics of the gases evolved from these additives during the life cycle. We will use alkylated or alkarylated dithiocarbamate as an antiwear. Their general formulation can be represented as:

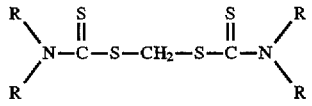

Where Rs can be alkyl, aryl, or both and having the same number of carbons or different from each other. An example of this formulation is when R is $C_4H_9$. This product is an antioxidant and in this invention is shown to function as an antiwear. One such chemical is commercially available under the name of Vanlube 7723 from R. T. Vanderbilt Company, Inc. Another similar structure that functions as an antiwear is Vanlube 732 from R. T. Vanderbilt Company, Inc. The preferred concentration for each compound is from 0.5 to about 3.0 percent by weight of the final lubricant formulation.

The lubricating oil also contains a silicone anti-foam additive. In a preferred embodiment of this invention, the silicone anti-foam agent is a compounded silicone fluid that is present in the final phosphorus-free in an amount of about 0.0005 to 0.0050 percent by weight of the final lubricant formulation.

The base oil also contains a copper passivator. Preferably the copper passivator is a benzotriazole derivative such as 1H-benzotriazole-1-Methanamine,N,N-bis(2-ethyl hexyl)-methyl. The copper passivator is preferably present in the final phosphorus-free ashless lubricating oil in an amount from about 0.05 to about 0.5 percent by weight of the final lubricant formulation.

The base oil also contains an inhibitor. Inhibitors are generally agents that prevent or minimize corrosion, wear, oxidation, friction, rest, and foaming. Preferably, the base oil contains a copper corrosion inhibitor that is preferably a 2,5-dimercapto-1,3,4-thiadiazole derivative. The copper corrosion inhibitor is present in the final ZDTP-free, with or without phosphorus, low ash or light ash lubricating oil in approximately 0.05 to about 0.5 percent by weight of the final lubricant formulation.

The base oil also contains a rest inhibitor/metal deactivator. One such inhibitor is (tetrapropenyl)-butanedioic acid, monoester with 1,2-propanediol and (tetrapropenyl)-butanedioic acid. The rest inhibitor is preferably present in the final phosphorus-free ashless lubricating oil in an amount from about 0.05 to about 0.5 percent by weight of the total lubricant formulation.

Finally, the base oil may optionally contain antioxidants. Antioxidants prevent premature degradation of components in the oil, prevent varnish, retard corrosion of alloy bearings, minimize the formation of sludge precursors and minimize the increase of oil viscosity due to oxidation. Antioxidants function by two mechanisms: (1) decomposing hydroperoxides and (2) scavenging reactive radicals. Hydroperoxide decomposers convert hydroperoxides into no-radical products, thus preventing a chain propagation reaction. Organosulfur, organophosphorus, zinc dialkyl dithiocarbamate and sulfurized olefins function by this mechanism. Radical scavengers react with free radicals, thus preventing the oxidative reactions that take place between them and oxygen. Hindered phenols, secondary aromatic amines, and zincdialkyldithiocarbamate function by this mechanism. Preferably, the antioxidant is a hindered phenolic antioxidant such as an isooctyl 3,5-di-tert-butyl-4-hydroxylhydrocinnamic acid; a dialkyl diphenylamine with the alkyl group having from 4 to 10 carbons; an alkylated or alkarylated phenyl α or β naphthylamine with the alkyl group having from 4 to 10 carbons; a methylene bis (dibutyldithiocarbamate), and an ester of dithiocarbamate derivatives or their combinations. The preferred total concentration of antioxidants is from about 2 to 8 percent by weight of the final lubricant formulation.

There are three preferred embodiments of the phosphorus-free and ashless lubricating oils made from the polyol ester base oils and additives discussed above. Each of the three embodiments first additionally contains an ashless antiwear system. Preferably, the ashless antiwear system is non-metal containing and consists of an alkylated or alkarylated dithiocarbamate derivative or a combination of these additives in an amount of about 0.5 to 3 percent by weight of the final lubricant formulation. In addition, the first embodiment of the phosphorus-free, ashless lubricating oil contains the hindered phenolic and amine antioxidants described above, each in an amount of about 0.5 to 3.0 percent by weight of the final lubricant formulation.

The preferred first embodiment also contains an anti-foam of polydimethyl siloxane in an amount of approximately 0.0005 to 0.0025 percent by weight of the final lubricant formulation.

Further, the first embodiment contains a copper passivator of benzotriazole derivative type such as 1H-benzotriazole-1-Methanamine-bis(2-ethyl hexyl)-methyl in an amount of approximately 0.05 to 0.2 percent by weight of the final lubricant formulation. Finally the first embodiment also contains a rust inhibitor/metal deactivator of (tetrapropenyl)

-butanedioic acid, monoester with 1,2-propanediol and (tetrapropenyl)-butanedioic acid in an amount of approximately 0.05 to 0.2 percent by weight of the final lubricant formulation.

The second preferred embodiment of the phosphorus-free, ashless lubricating oil contains a lubricating oil made from the polyol ester base oils of trimethylol propane triesters type and additives described in the first preferred embodiment.

The third preferred embodiment of the phosphorus-free, ashless lubricating oil contains a combination of pentaerythritol tetraesters type and trimethylol propane esters type and additives described in the first preferred embodiment.

The lubricating oils of the present invention are preferably prepared by the following procedure. The polyol ester base oil is stirred and heated to a temperature within the range of about room temperature, i.e., approximately 24° C. to about 80° C. The ingredients are then added to the base oil. Preferably, the solid antioxidant is added first and completely mixed before any other ingredients are added. Once all the chemicals have been added, the mixture is continually heated at about 80° C.±5° C. and constantly stirred for a sufficient time to insure complete mixing. All of the lubricating oil formulations described above may be used as is. The lubricating oil formulations described herein show remarkable performance in categories such as reducing engine friction and wear, reducing engine corrosion and oil oxidation.

It is also possible that concentrated formulations based on the above formulations be prepared. The concentrated formulations contain additives that are essential to protect engine components from wear, provide oxidation protection for the lubricating oil, provide metal deactivation, and provide reduced friction in moving parts. The concentrated formulations contain 2 to 20 times by weight as much additives as regular formulations contain. The above three embodiments can also be formulated with concentrated formulations. The concentrated formulations may be used to improve existing gas turbine engine oils or they may be sold as an after-market treatment package. The concentrated formulations are added to any commercial oils or oil in an engine after some use that needs more additives in an amount as little as 10% by volume of the final oil volume in the engine. When the concentrated additives are used in commercial oils in an amount of about 10% by volume, not only their performance will be improved, but also the manufacturing costs of producing the oil will be decreased.

It is to be understood that the application of the teachings of the present invention to a specific problem will be within the capabilities of one having ordinary skill in the art in light of the teachings contained herein. Examples of the products of the present invention and processes of their preparation and for their use appear in the following examples.

Experimental Procedures

For each of the examples appearing below the phosphorus-free and ashless lubricating oil was prepared by the following procedure: a polyol ester base oil or oils approximately composed of 90% of total volume made of pentaerythritol tetraesters, trimethylol propane esters, or their combinations were poured in a container equipped with a mechanical stirring machine and a controlled heating system. The temperature of the oil ranged from room temperature, that is approximately 24° C., to 60° C. While the base oil was under heating and constant stirring, specific quantities of other chemicals were added to the base oil. For optimization of the mixing process, the solid antioxidants and other possible solid ingredients were added first and after they were completely mixed, the other chemicals were added. Following the addition of all of the chemicals, the complete mixture was continually heated at 80° C.±5° C. and constantly stirred for two hours to insure complete mixing of all of the chemicals into the base oil.

The ingredients listed in Table 1 are those contained in each of the following examples. Thus, when an example refers to a compound followed by a number, the referred-to compound is the one which corresponds to the number listed in Table 1.

Certain standard tests were employed for assessing the gas turbine engine lubricant oil properties. Such tests are as follows:

| TEST | PURPOSE |
|---|---|
| • Modified 4-BALL Test | SCAR DIAMETER |
| • Modified 4-BALL Test | Friction Coefficient |
| • ASTM* 4636 | Corrosion and Oxidation Stability |

*American Society for Testing and Material

TABLE 1

| Code | Chemical | Chemical Name and Source |
|---|---|---|
| 1 | Base Oil | polyol esters made of pentaerythritol and a mixture of fatty acids or trimethylolpropane and a mixture of fatty acids or their combinations, esters of adipic acids with the general formula of $C_4H_8(COOR)_2$, where R ranges from diisooctyl to ditridecyl, azelate diesters with the general formula of $C_7H_{14}(COOR)_2$, where R ranges from diisooctyl to diisodecyl, sebacate diesters with general formula of $C_8H_{16}(COOR)_2$, where R is di-2-ethylhexyl or dioctyl, phthalate esters with the general formula of $(C_6H_4)(COOR)_2$, where R ranges from diisooctyl to ditridecyl, and esters of neopentyl glycol, aromatic hydrocarbons or ethers, silicone fluids and polyphenyl ethers. |
| 2 | Antioxidant | Methylene bis (dibutyldithiocarbaniate) (such as Vanlube 7723 from R.T. Vanderbilt Company, Inc.) |
| 3 | Antioxidant | Dithiocarbamate derivative (such as Vanlube 732 from R.T. Vanderbilt Company, Inc.) |
| 4 | Antioxidant | Thiodiethylene bis-(3,5-di-tert-butyl-4-hydroxy)hydrocinnamate (such as Irgonox L1035 from CIBA-GEIGY) |
| 5 | Antioxidant | Alkylated diphenylamine (such as VANLUBE NA from R.T. Vanderbilt Company, Inc.) |
| 6 | Antioxidant | p,p'-dioctyldiphenylamine (such as VANLUBE 81 from R.T. Vanderbilt Company, Inc. or Naugalube 438R from Uniroyal) |

TABLE 1-continued

| Code | Chemical | Chemical Name and Source |
|---|---|---|
| 7 | Antioxidant | octylated phenyl-α-naphthylamine (such as Irganox L06 from CIBA-GBIGY) |
| 8 | Antioxidant | Isopropyl diamine (such as Naugalube 410 from Uniroyal) |
| 9 | Anti-foam | Compounded Silicone Fluid (such as Anti-foam 200 (R) from Dow Corning) |
| 10 | Copper Passivator | Triazole Derivative 1H-Benzotriazole-1-Methanamine,N,N, Bis(2-Ethyl Hexyl) - Methyl (such as Reomet 39 from CIBA-GEIGY) |
| 11 | Copper Corrosion Inhibitor | 2,5-Dimercapto-1,3,4-Thiadiazole Derivative (such as Cuvan 826 from R.T. Vanderbilt Company, Inc.) |
| 12 | Rust Inhibitor | (Tetrapropenyl)-Butanedioic Acid, Monoester With 1,2-propanediol and (Tetrapropenyl)-butanedioic acid (such as REOCOR 12 from CIBA-GEIGY) |

EXAMPLE 1

The basic ingredients of Example 1 are:

About 93.9% by weight of the base oil (polyol esters) compound 1, 0.50% antioxidant compound 4, 0.50% antioxidant compound 5, 1% antioxidant compound 6, 1% antioxidant compound 7, 0.0025% of the silicone anti-foam additive compound 9, and 0.1% of the copper passivator compound 10.

To the basic ingredients about 1% methylene bis (dibutyldithiocarbamate) compound 2 and 2% dithiocarbamate derivative compound 3 were added and tested for friction coefficient efficiency and wear reduction.

Example 1 was compared to formulations made of the above basic ingredients and commercially available phosphorus-containing antiwear additives and also to a standard formulated compound commercially available for gas turbine engines. Table 2 compares the result of friction coefficient and wear using a modified 4-ball test.

TABLE 2

Friction coefficient and wear using a Modified 4-Ball Tester at 75° C. for Example 1 of this invention, phosphorus-containing formulations made of the basic ingredients and commercially available antiwear additives, and a standard commercial phosphorus-containing gas turbine engine lubricant

| Formulation | Friction Coefficient | Wear Measurement (mm) |
|---|---|---|
| Basic ingredients 3% type 1 phosphorus-containing antiwear gas turbine engine lubricant of Grade 4 centiStokes | 0.090 | 0.013 |
| Basic ingredients plus 2% type 2 phosphorus-containing antiwear gas turbine engine lubricant of Grade 4 centiStokes | 0.070 | 0.015 |
| Standard commercial phosphorus-containing gas turbine engine lubricant of Grade 4 centiStokes | 0.130 | 0.006 |
| Phosphorus-free gas turbine engine lubricant of Grade 4 centiStokes of this invention | 0.08 | 0.004 |

Test results of the Modified 4-Ball Tester clearly show that the Example 1 formulation of this invention is superior over the standard commercial phosphorus-containing gas turbine engine lubricant of Grade 4 centiStokes and other formulations made of the best phosphorus-containing antiwear additives. In comparison to the standard commercial phosphorus-containing gas turbine engine lubricant of Grade 4 centiStokes, friction coefficient was reduced 38% and wear was reduced by 33% and yet the gas turbine engine lubricant of this invention is phosphorus-free and environmentally benign and eliminates the possibility of generating neurotoxin chemicals during the high temperature operation which is attributed to the presence of phosphorus in gas turbine engine lubricants.

EXAMPLE 2

The basic ingredients of Example 2 are the same as Example 1.

To the basic ingredients about 3% methylene bis (dibutyldithiocarbamate) compound 2 was added and tested for friction coefficient efficiency and wear reduction.

Friction coefficient and wear of Example 2 at 175° C. were compared to those of base fluid (pentaerythritol tetraesters), to a formulation made of the basic ingredients of Example 1 and the best commercially available phosphorus-containing antiwear additive, and a standard phosphorus-containing formulation commercially available for gas turbine engines. Table 3 compares the result of friction coefficient and wear using a Modified 4-Ball Tester.

TABLE 3

Friction coefficient and wear using a Modified 4-Ball Tester at 175° C. for Example 2 of this invention, a phosphorus-containing formulation made of the basic ingredients of Example 1 and the best commercially available antiwear, and a standard commercial phosphorus-containing gas turbine engine lubricant

| Formulation | Friction Coefficient | Wear Measurement (mm) |
|---|---|---|
| Base fluid (pentaerythritol tetraester) | 0.110 | 0.045 |
| Basic ingredients with 3% type 1 phosphorus-containing antiwear gas turbine engine lubricant for grade 4 centiStokes | 0.110 | 0.030 |
| Standard commercial phosphorus-containing gas turbine engine lubricant for grade 4 centiStokes | 0.135 | 0.023 |
| Phosphorus-free gas turbine engine lubricant for grade 4 centiStokes of this invention | 0.080 | 0.0115 |

Test results of the Modified 4-Ball Tester clearly show that the Example 2 formulation is superior over the standard commercial phosphorus-containing gas turbine engine lubricant of Grade 4 centiStokes, a formulation made of the best phosphorus-containing antiwear additive, and also the base fluid. In comparison to the standard commercial phosphorus-containing gas turbine engine lubricant of grade 4 centiStokes, the lubricant of this invention reduced the friction coefficient by 41% and reduced wear by 50% and yet the gas turbine engine lubricant of this invention is phosphorus-free and is environmentally benign and eliminates the possibility of generating neurotoxin chemicals at high temperature operations which is attributed to the presence of phosphorus in gas turbine engine lubricants.

What is claimed:

1. A phosphorus-free ashless lubricating oil for aircraft and turbo engine end-use application comprising:

from about 90 to 97 percent by weight of the final lubricant formulation of synthetic base oil selected from tetraesters of pentaerythritol, triesters of methylolpropane, and mixture thereof; and the base oil optionally further includes one or more of polyol esters selected from adipate diesters, azelate diesters, sebacate diesters, phthalate diesters, and neopentyl diesters as well as optionally one or more of vegetable oils selected from castor oil, sunflower oil, grape seed oil, or lard oil, from about 0.5 to 4 percent by weight of the final lubricant formulation an antioxidant/extreme pressure additive selected from the group consisting of alkylated or alkarylated dithiocarbamate or combinations thereof, wherein said the lubricant oil is absolutely free of phosphorus, metals, metal salts, and detergent/dispersant.

2. The lubricating oil composition of claim 1 further comprising an effective amount of one or more antioxidant selected from alkylamine or alkylphenylamine or alkarylphenylamine or their combinations.

3. The lubricating oil composition of claim 1 further comprising an effective amount of one or more antioxidant selected from alkylated phenyl-α-naphthylamine or alkylated phenyl-β-naphthylamine or their combinations.

4. The lubricating oil composition of claim 1 further comprising an effective amount of silicon anti-foam additive.

5. The lubricating oil composition of claim 1 further comprising an effective amount of a copper passivator.

6. The lubricating oil composition of claim 1 further comprising an effective amount of a rust inhibitor/metal deactivator.

7. The lubricating oil composition of claim 1 further comprising a pentaerythritol of fatty acids having five to seven carbon atoms in the molecular structure of the acids.

8. The lubricating oil composition of claim 1 further comprising a trimethylolpropane triester of mixture fatty acids having five to nine carbon atoms in the molecular structure of the acids.

9. The lubricating oil composition of claim 1 further comprising a blend of pentaerythritol of fatty acids having five to seven carbon atoms in the molecular structure of the acids and a trimethylolpropane triester of mixture fatty acids having five to nine carbon atoms in the molecular structure of the acids.

10. The lubricating oil composition of claim 2, wherein the antioxidant is p,p'-dioctyldiphenylamine in the concentration ranging from about 0.5 to about 3 percent by weight of the final lubricant formulation.

11. The lubricating oil composition of claim 3, wherein said the antioxidant is octylated phenyl-α-naphthylamine in the concentration ranging from about 0.5 to about 3 percent by weight of the final lubricant formulation.

12. The lubricating oil composition of claim 4, wherein the anti-foam is polydimethylsiloxane having a 350 centiStokes viscosity in the concentration ranging from about 0.0005 to about 0.0025 percent by weight of the final lubricant formulation.

13. The lubricating oil composition of claim 5, wherein the copper passivator is a substituted benzotriazole in the concentration ranging from about 0.05 to about 0.2 percent by weight of the final lubricant formulation.

14. The lubricating oil composition of claim 6, wherein the rust inhibitor is (tetrapropenyl)-butanedioic acid monoester with 1,2-propanediol in the concentration ranging from about 0.05 to about 0.20 percent by weight of the final lubricant formulation.

15. The lubricating oil composition of claim 1, wherein the antioxidant/extreme pressure additive is methylene bis (dibutyl dithiocarbamate).

* * * * *